United States Patent [19]

Osaki

[11] Patent Number: 4,457,062

[45] Date of Patent: Jul. 3, 1984

[54] METHOD OF AND APPARATUS FOR DETECTING ENDS OF SUCCESSIVE FLY STRIPS CONNECTED BY A SLIDE FASTENER CHAIN

[75] Inventor: Tatsuo Osaki, Uozu, Japan

[73] Assignee: Yoshida Kogyo K. K., Tokyo, Japan

[21] Appl. No.: 414,073

[22] Filed: Sep. 2, 1982

[30] Foreign Application Priority Data

Sep. 9, 1981 [JP] Japan ..... 56-140884

[51] Int. Cl.[3] ..... B21D 53/50; A41H 37/06

[52] U.S. Cl. ..... 29/408; 29/766; 29/770

[58] Field of Search ..... 29/408, 409, 410, 332, 29/766, 769; 24/205 R, 205 G, 205.1 R

[56] References Cited

U.S. PATENT DOCUMENTS

| | | | |
|---|---|---|---|
| 2,823,388 | 2/1958 | Prupis et al. | 29/770 |
| 2,836,239 | 5/1958 | Johns et al. | 29/770 |
| 3,570,104 | 3/1971 | Jensen | 29/766 |
| 4,236,292 | 12/1980 | Orr et al. | 29/408 |
| 4,333,232 | 6/1982 | Orr et al. | 29/770 |

*Primary Examiner*—Howard N. Goldberg
*Assistant Examiner*—Steven E. Nichols
*Attorney, Agent, or Firm*—Hill, Van Santen, Steadman & Simpson

[57] ABSTRACT

A method of and apparatus for detecting ends of successive fly strips connected end to end by a slide fastener chain. The successive fly strips, with their first flaps overlapping a tape of one fastener stringer and with their second flaps overlapping the other fastener stringer, are fed lengthwise along a straight path. Then, the second flaps are folded over the respective first flaps as the fly strips pass through a folder extending through a fixed point on the straight path. During this folding, a trailing end of the preceding second flap is temporarily deflected so as to provide a relatively large triangular space between confronting ends of an adjacent pair of the second flaps when the same confronting ends arrive at the fixed point. Finally, a detector senses the presence of the triangular space, which indicates the arrival of confronting ends of an adjacent pair of the fly strips.

11 Claims, 7 Drawing Figures

METHOD OF AND APPARATUS FOR DETECTING ENDS OF SUCCESSIVE FLY STRIPS CONNECTED BY A SLIDE FASTENER CHAIN

BACKGROUND OF THE INVENTION

1. Field of the Invention

The present invention relates to automation of the manufacture of trouser closures for fly openings, and more particularly to a method of and apparatus for detecting ends of a succession of fly strips connected end to end by a slide fastener chain.

2. Prior Art

In the manufacture of trouser closures for fly openings, a slide fastener chain, to which a succession of fly strips is attached, is fed to an intermittently operating apparatus for forming element-free gaps in the fastener chain. To this end, it has been the common practice to detect ends of the successive fly strips in order to automatically control the intermittent operation of the element-free gap forming apparatus; confronting ends of an adjacent pair of the fly strips are senssed by a feeler or other mechanical means. However, the successive fly strips are connected end to end in substantially abutting relation with only a very small space between an adjacent pair of the fly strips. With this smallness of the inter-fly spaces, accurate detection of the fly ends is difficult to achieve. U.S. Pat. No. 3,570,104, issued Mar. 16, 1971 to P. B. Jensen, is believed to exemplify the prior art.

SUMMARY OF THE INVENTION

It is an object of the present invention to provide a method of detecting ends of successive fly strips connected end to end in substantially abutting relation by a slide fastener chain, and to do so accurately with maximum ease.

Another object of the invention is to provide an apparatus for carrying out the above-mentioned method, which is very simple in construction and hence inexpensive.

According to the present invention, a succession of fly strips connected end to end in substantially abutting relation by a pair of continuous slide fastener stringers is provided as a starting material. The successive fly strips, with their first flaps overlapping a tape of one fastener stringer and with their second flaps overlapping the other fastener stringer, are fed lengthwise along a straight path. Then, the second flaps are folded over the respective first flaps as the fly strips pass through a folder extending through a fixed point on the straight path. During this folding, a trailing end of the preceding second flap is temporarily deflected so as to provide a relatively large triangular space between confronting ends of an adjacent pair of the second flaps when the same confronting ends arrive at the fixed point. Finally, a detector senses the presence of the triangular space, which indicates the arrival of confronting ends of an adjacent pair of the fly strips.

Many other advantages and features of the present invention will become manifest to those versed in the art upon making reference to the detailed description and the accompanying sheets of drawings in which several preferred structural embodiments incorporating the principles of the present invention are shown by way of example.

DETAILED DESCRIPTION

Figure 1:
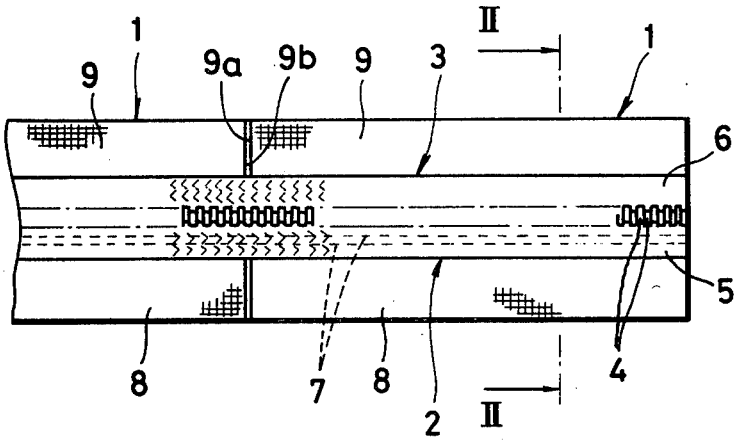
FIG. 1 is a fragmentary plan view of a slide fastener chain to which a series of fly strips is attached.
Figure 2:
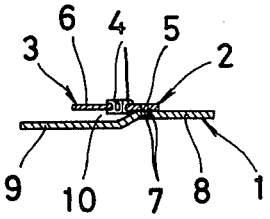
FIG. 2 is a transverse cross-sectional view taken along line II—II of FIG. 1.

FIG. 1 shows a succession of fly strips 1 connected end to end in substantially abutting relation by a pair of continuous fastener stringers 2,3 having a pair of interengaged rows of coupling elements 4,4 mounted on a pair of tapes 5,6 along their confronting longitudinal edges. The successive fly strips 1 are attached to the tape 5 of one fastener stringer 2 by at least one line of stitching 7 dividing each fly strip 1 into a first and a second flap 8,9. As better shown in FIG. 2, the first flap 8 underlaps only the tape 5 in close relation therewith, while the second flap 9 underlaps not only the other tape 6 but also the pair of interengaged coupling element rows 4,4 with a relatively small gap 10 between the second flap 9 and the other fastener stringer 3.

Figure 3:
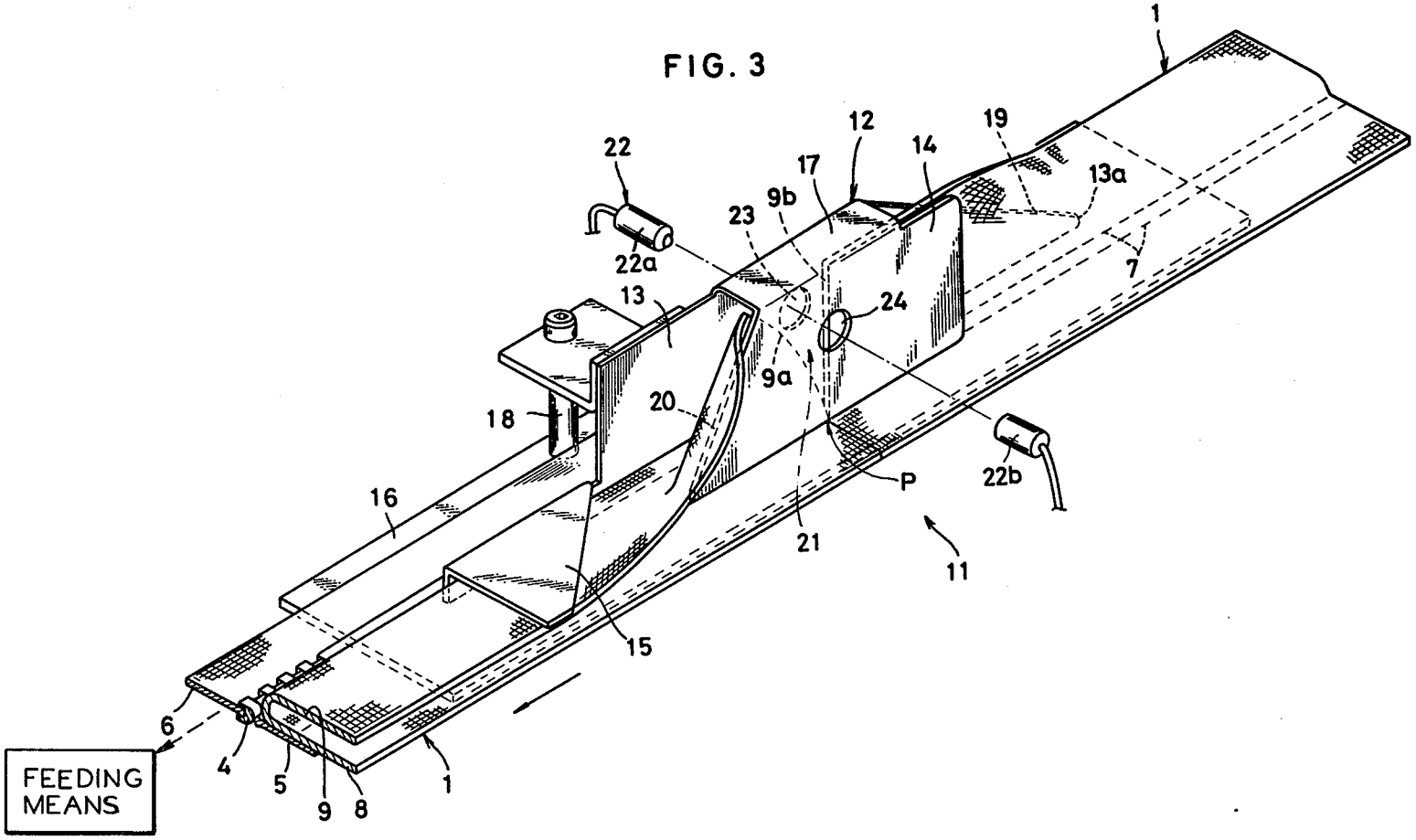
FIG. 3 is a fragmentary perspective view of an apparatus according to a first embodiment of the present invention, showing the manner in which the trailing end of a second flap of the preceding fly strip is deflected by a folder.
Figure 4:
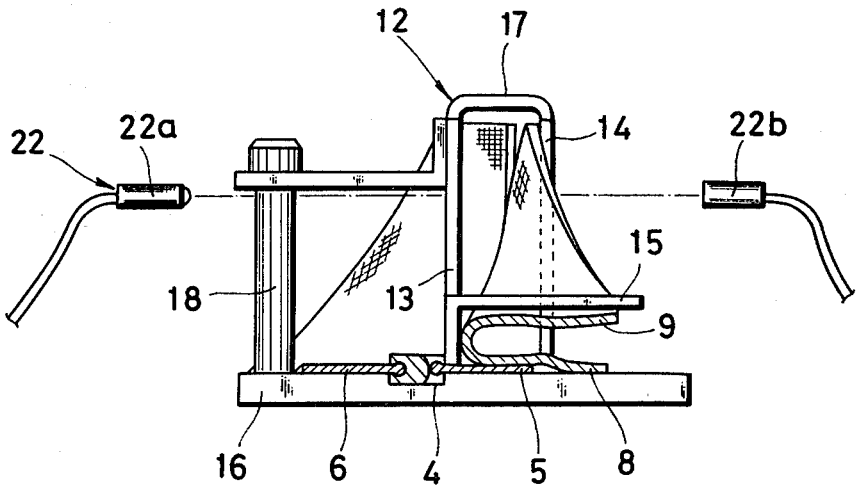
FIG. 4 is an end elevational view of the structure of FIG. 3.

FIGS. 3 and 4 show an apparatus 11 for detecting ends of the successive fly strips 1. The apparatus 11 comprises a drive unit (not shown) for feeding the successive fly strips 1 lengthwise on a support table 16 along a straight path through a fixed point P. The apparatus 11 also comprises a folder 12 disposed on the straight path for folding the successive second flaps 9 over the respective first flaps 8.

The folder 12 includes a first, a second and a third guide member 13,14,15. The first and second guide members 13,14 lie at a right angle to the support table 16 and thus to the general plane of the fastener stringers 2,3 and extend longitudinally of the straight path through the fixed point P. The first and second guide members 13,14 are parallel and are spaced apart from one another and are joined at their upper edges by a connecting portion 17, the first guide member 13 being supported by a post 18 on the support table 16.

The first guide member 13 has a first sloping edge 19 disposed upstream of the fixed point P for pre-folding or bending the successive second flaps 9, one at a time, to such an extent that each second flap 9 lies at a right angle to the general plane of the fastener stringers 2,3.

The second guide member 14 has a second sloping edge 20 disposed immediately downstream of the fixed point P. The third guide member 15 is disposed downstream of the second sloping edge 20 and extends from an extension of the first guide member 13 transversely of the straight path in close parallel spaced relation to the general plane of the fastener stringers 2,3. The second sloping edge 20 and the third guide member 15 are coactive to fold the pre-folded second flaps 9 successively, to such an extent that each second flap 9 overlaps the corresponding first flap 8, so that a free corner of the trailing end 9*a* of the preceding second flap 9 is deflected or moved away from that of the leading end 9*b* of the succeeding second flap 9 so as to provide temporarily a triangular space 21 between confronting ends 9*a*, 9*b* of an adjacent pair of the second flaps 9,9 when the confronting ends 9*a*, 9*b* arrive at the fixed point P.

A detector 22 (FIGS. 3 and 4) is disposed adjacent to the fixed point P for sensing the presence of the triangular space 21 between an adjacent pair of the second flaps 9,9. The detector 22 includes a light source 22*a* positioned on one side of the folder 12, and a photoelectric transduceer element 22*b* positioned on the other side of the folder 12 for receiving the light passed through the triangular space 21. The folder 12 has a pair of opposed openings 23,24 in the first and second guide members 13,14, respectively, for allowing the light to pass through the folder 12. The photoelectric transducer element 22*b* produces a signal pulse every time each triangular space 21 is sensed by the detector 22. Thus the signal pulse indicates that the confronting ends 9*a*, 9*b* of an adjacent pair of the second flaps 9,9, i.e. a trailing end of the corresponding preceding fly strip 1 and a leading end of the corresponding succeeding fly strip 1, have arrived at the fixed point P.

The non-illustrated drive unit may include a pair of feed rollers, one of which is a driven roller to which a counter is operatively connected for counting the number of revolutions of the driven roller. Upon receipt of a signal pulse from the detector 22, the counter starts to count the number of revolutions of the driven roller until the next signal pulse from the detector 22 issues, thereby measuring the length of the individual fly strip 1. The counter produces an output signal for automatically controlling an intermittently operating peripheral apparatus, such as an element-free gap forming apparatus (not shown) to which the straight path leads, depending on the length of each individual fly strip 1. At the same time, the output signal is applied to the drive unit to control the feeding of the successive fly strips 1 in timed relation with the intermittent operation of such a peripheral apparatus.

In operation, the successive fly strips 1, with the first flap 8 overlapping the tape 5 of one fastener stringer 2 and with the second flap 9 overlapping the other fastener stringer 3, are fed along the straight path. When the leading end 9*b* of one of the successive fly strips 1 arrives at the folder 12, a tapering leading end 13*a* of the first guide member 13 enters the relatively small gap 10 (FIG. 2) between the other fastener stringer 3 and the second flap 9 of the one fly strip 1. With continued movement of the fly strips 1, the same second flap 9 is pre-folded or bent progressively, as it slides on the first sloping edge 19, until the second flap 9 lies at a right angle to the general plane of the fastener stringers 2,3. The pre-folded second flap 9 is then guided by the first and second guide members 13,14 to the fixed point P.

Then, the pre-folded second flap 9 is folded completely, to such an extent that the second flap 9 overlaps the corresponding first flap 8. During this folding, the relatively large triangular space 21 is temporarily provided between the confronting ends 9*a*,9*b* of an adjacent pair of the successive second flaps 9,9 when the same confronting ends 9*a*,9*b* arrive at the fixed point P. This relatively large interflap space 21 allows the light from the light source 22*a* to pass through the space 21 to the reach the photoelectric transducer element 22*b*. The photoelectric transducer element 22*b* produces a signal pulse, which indicates that the confronting ends 9*a*,9*b* of an adjacent pair of the second flaps 9,9, i.e. a trailing end of the preceding fly strip 1 and a leading end of the succeeding fly strip 1, have arrived at the fixed point P. Upon receipt of the signal pulse from the photoelectric transducer element 22*b*, the non-illustrated counter starts to count the number of revolutions of the non-illustrated driven roller until the next signal pulse from the photoelectric transducer element 22*b* issues, thereby measuring the length of the individual fly strip 1. The counter produces an output signal for automatically controlling an intermittently operating peripheral apparatus, such an an element-free gap forming apparatus (not shown) to which the straight path leads, depending on the length of each individual fly strip 1.

Figure 5:
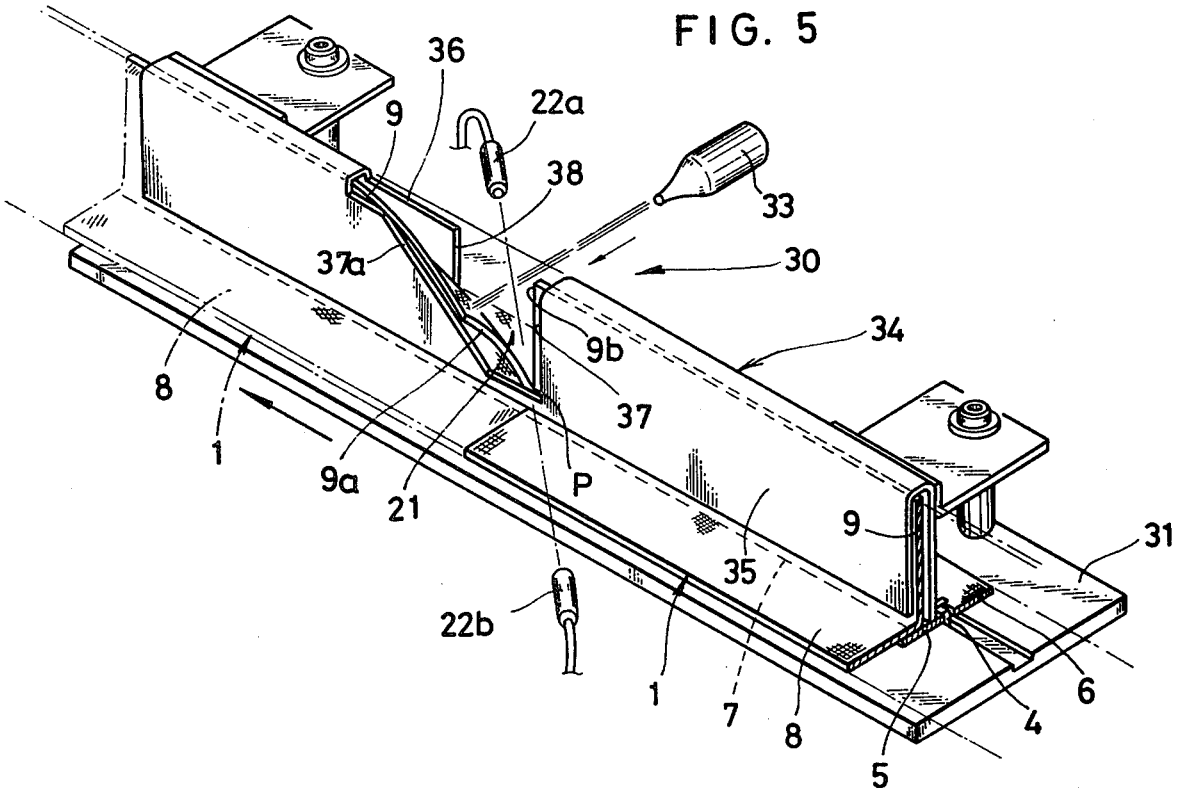
FIG. 5 is a perspective view, with parts omitted, of a modified apparatus according to a second embodiment, showing the manner in which the trailing end of a second flap of the preceding fly strip is deflected by means of a jet nozzle.

FIG. 5 shows a modified apparatus 30 according to a second embodiment. The apparatus 30 comprises a drive unit (not shown) for feeding the successive fly strips 1 lengthwise on a support table 31 along the straight path through the fixed point P. The apparatus 30 also comprises a bender (FIG. 6) disposed on the straight path upstream of the fixed point P for bending or moving aside the successive second flaps 9, as they pass the bender 32, to such an extent that each second flap 9 lies at a right angle to the general plane of the fastener stringers 2,3.

A jet nozzle 33 as a deflector is disposed adjacent to the fixed point P for emitting pressurized fluid against a free corner of the trailing end 9*a* of the preceding second flap 9 from one side thereof to temporarily deflect the trailing end 9*a* of the same second flap 9 to provide a relatively large triangular space 21 between confronting ends 9*a*,9*b* of an adjacent pair of the successive second flaps 9,9 when the same confronting ends 9*a*,9*b* arrive at the fixed point P. The pressurized fluid comprises preferably air. An upright guide 34 extends longitudinally of the straight path through the fixed point P and includes a pair of parallel spaced side members 35,36 defining therebetween a passage for the successive second flaps 9, there being a pair of opposed cutouts 37,38 in the side members 35,36, respectively, for allowing the deflected corner of the trailing end 9*a* of the preceding second flap 9 to project out of the guide 34. The downstream side of the cutout 37 of one of the side members 35 is partly defined by a laterally sloping edge 37*a*, which facilitates the deflection of the second flaps 9.

Figure 7:
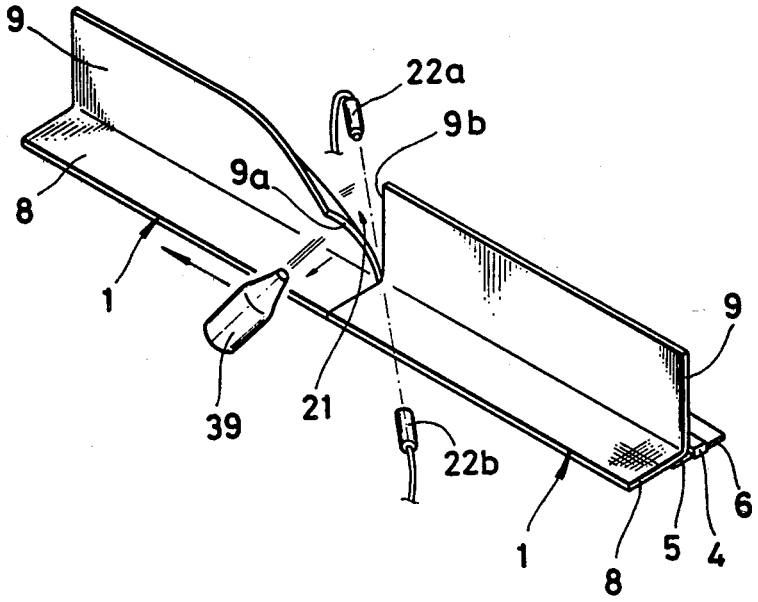
FIG. 7 is a fragmentary schematic perspective view, with parts omitted, of a modified apparatus according to a third embodiment, showing the manner in which the trailing end of a second flap of the preceding fly strip is deflected by means of a suction nozzle.

The jet nozzle 33 may be replaced by a suction nozzle 39 for drawing air near a free corner of the trailing end 9*a* of the preceding second flap 9 from one side thereof, as shown in FIG. 7.

In the apparatus 30 of FIG. 5, the relatively large triangular space 21 provided between the confronting ends 9*a*,9*b* of an adjacent pair of the second flaps 9,9 is sensed by a detector 22 similar to that of the embodiment of FIGS. 3 and 4.

The bender (FIG. 6) comprises a wedge-shaped plow 32 disposed on the straight path remotely from the fixed point P for moving aside the successive second flaps 9 one at a time, as the successive fly strips 1 pass the plow 32. The plow 32 is fixed to a post (not shown) on the support table 31.

Figure 6:
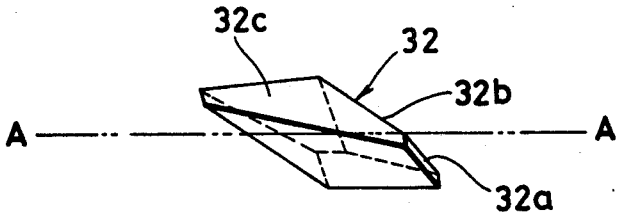
FIG. 6 is a perspective view of a bender.

The wedge-shaped plow 32 has a transverse leading edge 32*a*, a sloping top surface 32*b*, and a canted side surface 32*c* extending obliquely with respect to the straight path. The leading edge 32*a* is thin enough to readily enter between the tape 6 of the other fastener stringers 3 and the individual second flap 9 as the leading end 9*b* of the latter arrives at the plow 32. In FIG. 6, a dash-and-two-dot line A—A represents the longitudinal center line of the fastener stringers 2,3, i.e. the axis of the pair of coupling element rows 4. The leading edge 32*a* is disposed at the other-fastener-stringer side of the line A—A.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of detecting ends of successive fly strips connected end to end in substantially abutting relation by a pair of continuous slide fastener stringers, and fly strips being attached to a tape of one of the fastener stringers by at least one line of stitching dividing each fly strip into a first and a second flap, said method comprising the steps of:

(a) feeding the successive fly strips lengthwise along a straight path, with the first flaps superimposed on the tape of the one fastener stringer and with the second flaps superimposed on the other fastener stringer;

(b) folding the successive second flaps over the respective first flaps as the fly strips pass a fixed point on said straight path;

(c) during said folding, temporarily deflecting a trailing end of a preceding second flap to provide a triangular space between confronting ends of an adjacent pair of the successive second flaps when said confronting ends arrive at said fixed point; and (d) sensing the presence of said successive triangular spaces.

2. A method of detecting ends of successive fly strips connected end to end in substantially abutting relation by a pair of continuous slide fastener stringers, the fly strips being attached to a tape of one of the fastener stringers by at least one line of stitching dividing each fly strip into a first and a second flap, said method comprising the steps of:

(a) feeding the successive fly strips lengthwise along a straight path through a fixed point thereof, with the first flap superimposed on the tape of the one fastener stringer and with the second flaps superimposed on the other fastener stringer;

(b) bending the successive second flaps, before they arrive at said fixed point, to such an extent that each second flap lies at a right angle to the general plane of the fastener stringers;

(c) temporarily deflecting a trailing end of a preceding second flap to provide a triangular space between confronting ends of an adjacent pair of the successive second flaps when said confronting ends arrive at said fixed point; and (d) sensing the presence of said successive triangular spaces.

3. An apparatus for detecting ends of successive fly strips connected end to end in substantially abutting relation by a pair of continuous slide fastener stringers, the fly strips being attached to a tape of one of the fastener stringers by at least one line of stitching dividing each fly strip into a first flap superimposed on the tape of the one fastener stringer and a second flap superimposed on the other fastener stringer, said apparatus comprising:

(a) means for feeding the successive fly strips lengthwise along a straight path;

(b) a folder disposed at a fixed position on said straight path for folding the successive second flaps over the respective first flaps as the successive second flaps pass said folder, said folder being adapted at a fixed point to temporarily deflect a trailing end of a preceding second flap to provide a triangular space between confronting ends of an adjacent pair of the successive second flaps when said confronting ends arrive at said fixed point; and (c) a detector, disposed in such a position that the triangular spaces between the successive second flaps are sensed by said detector successively as the successive fly strips are fed, for producing a signal pulse every time each triangular space is sensed by a detector, said signal pulse being indicative of the arrival of confronting ends of an adjacent pair of the fly strips.

4. An apparatus according to claim 3, said folder comprising a first, a second and a third guide member, said first and second guide members being adapted to lie at a right angle to the general plane of the fastener stringers and extending longitudinally of said straight path through said fixed point, said first guide member having a first sloping edge disposed upstream of said fixed point for pre-folding the successive second flaps, one at a time, to such an extent that each second flap lies at a right angle to the general plane of the fastener stringers, said second guide member having a second sloping edge disposed immediately downstream of said fixed point, said third guide member being disposed downstream of said second sloping edge and extending tranversely of said straight path in close parallel spaced relation to the general plane of the fastener stringers, said second sloping edge and said third guide member being coactive to fold the pre-folded second flaps successively, to such an extent that each second flap overlaps the corresponding first flap, so that a free corner of the trailing end of the preceding second flap is moved away from the leading end of the succeeding second flap when the confronting ends of an adjacent pair of the second flaps arrive at said fixed point.

5. An apparatus for detecting ends of successive fly strips connected end to end in substantially abutting relation by a pair of continuous slide fastener stringers, the fly strips being attached to a tape of one of the fastener stringers by at least one line of stitching dividing each fly strip into a first flap superimposed on the tape of the one fastener stringer and a second flap superimposed on the other fastener stringer, said apparatus comprising:

(a) means for feeding the successive strips lengthwise along a straight path through a fixed point thereof;

(b) a bender disposed on said straight path upstream of said fixed point for bending the successive second flaps, as they pass said bender, to such an extent that each second flap lies at a right angle to the general plane of the fastener stringers;

(c) a deflector disposed adjacent to said fixed point for temporarily deflecting a trailing end of a preceding second flap to provide a triangular space between confronting ends of an adjacent pair of the successive second flaps when said confronting ends arrive at said fixed point; and (d) a detector, disposed in such a position that the triangular spaces between the successive second flaps are sensed by said detector successively as the successive fly strips are fed, for producing a signal pulse every time each triangular space is sensed by said detector, said signal pulse being indicative of the arrival of confronting ends of an adjacent pair of the fly strips.

6. An apparatus according to claim 5, said bender comprising a wedge-shaped plow having a transverse leading edge, a sloping top surface, and a side surface extending obliquely with respect to said straight path, said leading edge being thin enough to readily enter between the other fastener stringer and the individual second flap when a leading end of the corresponding fly strip arrives at said wedge-shaped plow.

7. An apparatus according to claim 6, said side surface of said wedge-shaped plow being canted.

8. An apparatus according to claim 5, said deflector comprising a jet nozzle for emitting pressurized fluid against a free corner of the trailing end of the preceding second flap from one side thereof.

9. An apparatus according to claim 5, said deflector comprising a suction nozzle for drawing air near a free corner of the trailing end of the preceding second flap from one side thereof.

10. An apparatus according to claim 8 or 9, said deflector further including an upright guide extending longitudinally of said striaght path through said fixed point, said guide including a pair of parallel spaced side members defining therebetween a passage for the successive second flaps, said side members having a pair of opposed cutouts around said fixed point for allowing the deflected corner of the trailing end of the preceding second flap to project out of said guide.

11. An apparatus according to claim 10, the downstream side of the cutout of one of said side members being partly defined by a laterally sloping edge for facilitating the deflecting of the second flaps.

* * * * *